US005606929A

United States Patent [19]

Huang

[11] Patent Number: 5,606,929

[45] Date of Patent: Mar. 4, 1997

[54] NAVY PONTOON LOCKING SYSTEM

[75] Inventor: Tsongshih Huang, Westlake Village, Calif.

[73] Assignee: The United States of America as represented by the Secretary of the Navy, Washington, D.C.

[21] Appl. No.: 687,097

[22] Filed: Jul. 8, 1996

[51] Int. Cl.[6] ..... B63B 3/02

[52] U.S. Cl. ..... 114/77 R; 14/2.6

[58] Field of Search ..... 14/2.6; 114/26, 114/61, 123, 77 R, 77 A, 352, 353, 354

[56] References Cited

U.S. PATENT DOCUMENTS

| | | | |
|---|---|---|---|
| 3,651,528 | 3/1972 | Behrmann et al. | 14/2.6 |
| 3,805,721 | 4/1974 | Robishaw | 114/77 R |
| 3,983,830 | 10/1976 | Morgan | 114/77 R |
| 4,487,151 | 12/1984 | Deiana | 14/2.6 |

*Primary Examiner*—Stephen Avila
*Attorney, Agent, or Firm*—David S. Kalmbaugh; Ron G. Billi; Melvin J. Sliwka

[57] ABSTRACT

Accordingly, the preferred embodiment of the present invention includes first and second pontoons; a plurality of removable connector modules located in pockets on each end of the pontoons for absorbing impacts and for locking together joined pontoons; a plurality of retractable, resilient alignment pins located in the ends of the pontoons for initial alignment of the pontoons; and a winch operated bridal line attached to the alignment pins, via guide bores, for drawing together the pontoons in a joined fashion. Each connector module includes, on one end, a compressible locking pin that may be slidably located in the extended position (for joining and locking together with another pontoon) or in the retracted position (for storage). The other end of the connector module includes a receiver bore for receiving the locking pin of a mating pontoon. The removable connector modules may be installed in a "regular" fashion, with the locking pin adjacent the deck of the pontoon or in the "inverted" fashion, with the locking pin adjacent the sea surface. Once joined together, two pontoons are locked together via the locking pins. The locking pins also may compress to absorb impacts from a mating pontoons due to misalignment of the pontoons in rough, undulating seas. The alignment pins are resilient to initially guide and absorb forces between bumping pontoons as the pontoons are drawn together. Several pontoons may be joined, in succession, to form an array of pontoons of desired length by repositioning the bridal line to attach to the next pontoon to be joined. Pontoons may also be joined, for example, at the side to form other combinations of structures.

15 Claims, 8 Drawing Sheets

NAVY PONTOON LOCKING SYSTEM

BACKGROUND OF THE INVENTION

This invention relates to floating structures, such as pontoons, that are attached, preferably, in an end-to-end fashion to form a continuous array that may be towed, for example, by a barge, tug or similar device. More specifically, but without limitation, the present invention relates to an apparatus for drawing together, aligning and locking together two or more pontoons, while on the undulating sea, to form a continuous array that may be towed by a barge.

The connecting and locking together of pontoons presents a difficult, dangerous and labor intensive task. Pontoons are usually partially connected on land or on the deck of an amphibious support ship and thereafter the completed assembly is placed on the sea surface by means, such as a crane. Alternatively, pontoons may be assembled or joined within the calm of a sheltered inlet or lee, when available, and then towed to a desired location.

These approaches, however, include serious limitations. When pontoons are assembled on the deck of a ship, significant deck space, crane support and manpower must be available. Deck crews are exposed to hanging cables and swinging pontoons weighing tens of tons, while they manually guide the pontoons together and activate the connectors that secure the pontoons to one another. These conditions can result in serious injury or death.

Alternatively, pontoons may be assembled on the calm sea surface or in the confines of a calm sheltered area when the seas are weltering. Many times, however, a calm area is not available. Furthermore, the assembling of pontoons in weltering seas, places the assemblers amid tensioned and traveling cables and bobbing and banging pontoons creating a potentially lethal situation as connectors are manually activated therebetween. The danger is so acute, that pontoons are not assembled on the sea surface unless the sea is calm.

Thus, there is a need for a pontoon locking system that may be used in weltering seas, that minimizes the risk of injury to assemblers and that facilitates the drawing together, aligning and locking together of two or more pontoons.

SUMMARY OF THE INVENTION

Accordingly, the preferred embodiment of the present invention includes first and second pontoons; a plurality of removable connector modules located in pockets on each end of the pontoons for absorbing impacts and for locking together joined pontoons; a plurality of retractable, resilient alignment pins located in the ends of the pontoons for initial alignment of the pontoons; and a winch operated bridal line attached to the alignment pins, via guide bores, for drawing together the pontoons in a joined fashion. Each connector module includes, on one end, a compressible locking pin that may be slidably located in the extended position (for joining and locking together with another pontoon) or in the retracted position (for storage). The other end of the connector module includes a receiver bore for receiving the locking pin of a mating pontoon. The removable connector modules may be installed in a "regular" fashion, with the locking pin adjacent the deck of the pontoon or in the "inverted" fashion, with the locking pin adjacent the sea surface. Once joined together, two pontoons are locked together via the locking pins. The locking pins also may compress to absorb impacts from a mating pontoon due to misalignment of the pontoons in rough, undulating seas. The alignment pins are resilient to initially guide and absorb forces between bumping pontoons as the pontoons are drawn together. Several pontoons may be joined, in succession, to form a array of pontoons of desired length by repositioning the bridal line to attach to the next pontoon to be joined. Pontoons may also be joined, for example, at the sides to form other combinations of structures.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
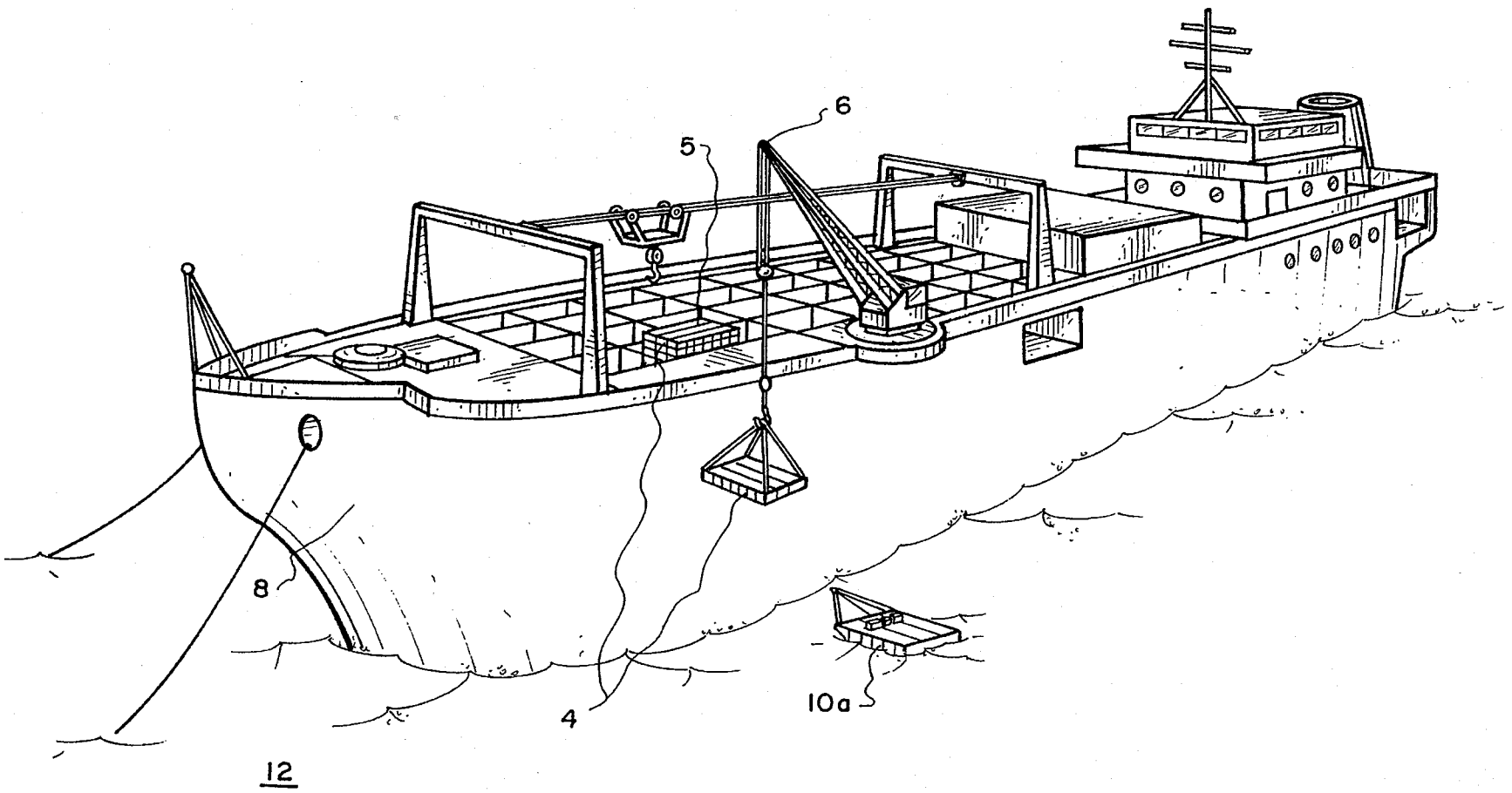
FIG. 1 is an illustration showing a ship offloading pontoons.

The preferred embodiment of the present invention is illustrated by way of example in FIGS. 1 to 9. FIG. 1 shows crane 6 offloading pontoons 4 from the deck of ship 8 and placing the pontoons 4 on the sea surface 12 in the vicinity of barge 10*a*. Barge 10*a* then begins the process of effecting the joining of the pontoons in an end to end fashion as shown, for example, in FIG. 2. Barge 10*b* is shown providing pretension assistance to pontoon 4*b* which, although not required, greatly facilitates the drawing together, aligning and locking of two pontoons. The pretensioning is effected in FIG. 2, by establishing a drag on pontoon 4*b* via tension lines 7. Other means may be used to effect a drag on pontoon 4*b*.

Figure 2:
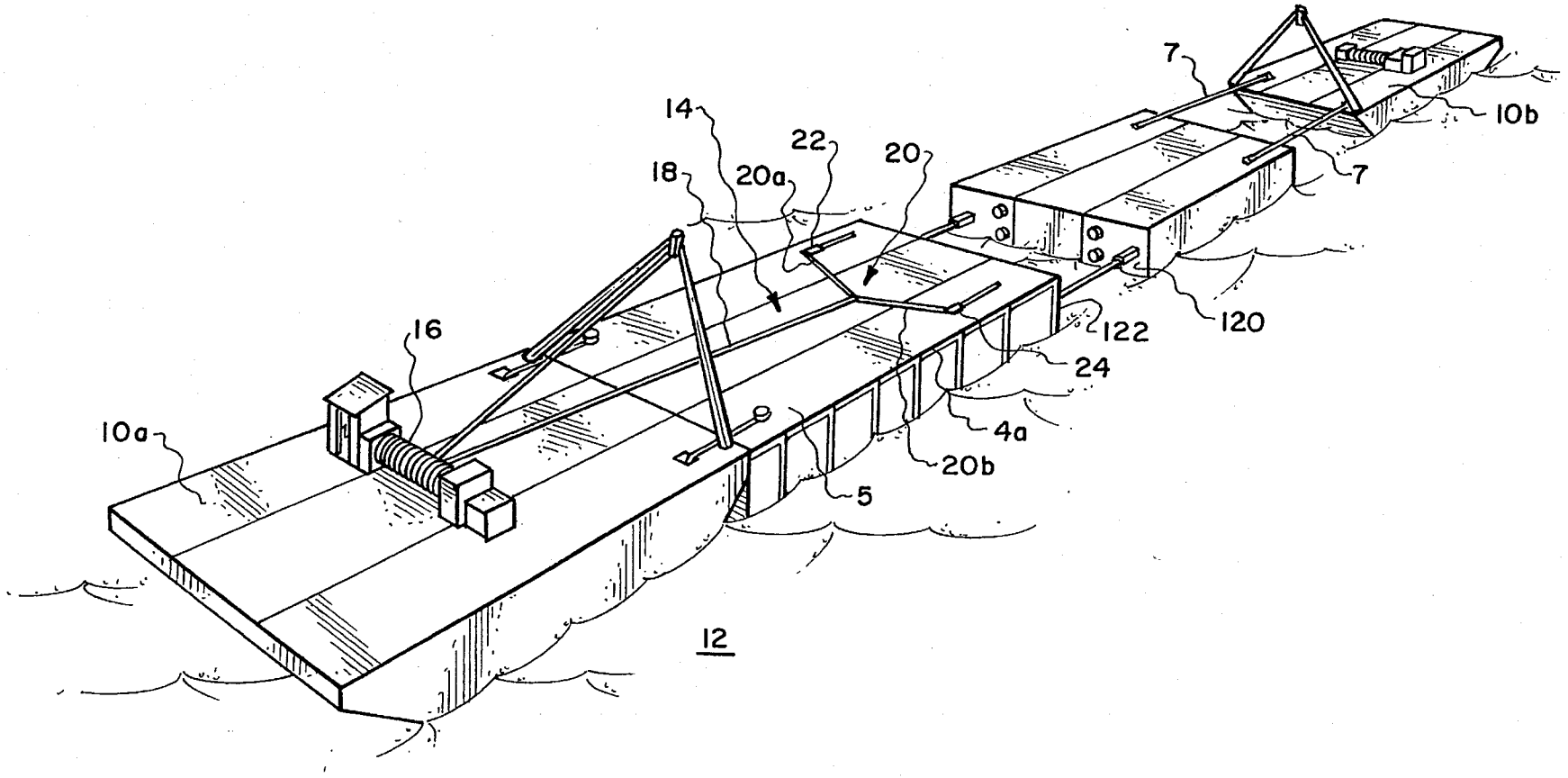
FIG. 2 is an illustration showing a leading barge drawing together two pontoons and a trailing barge providing pretension.
Figure 3:
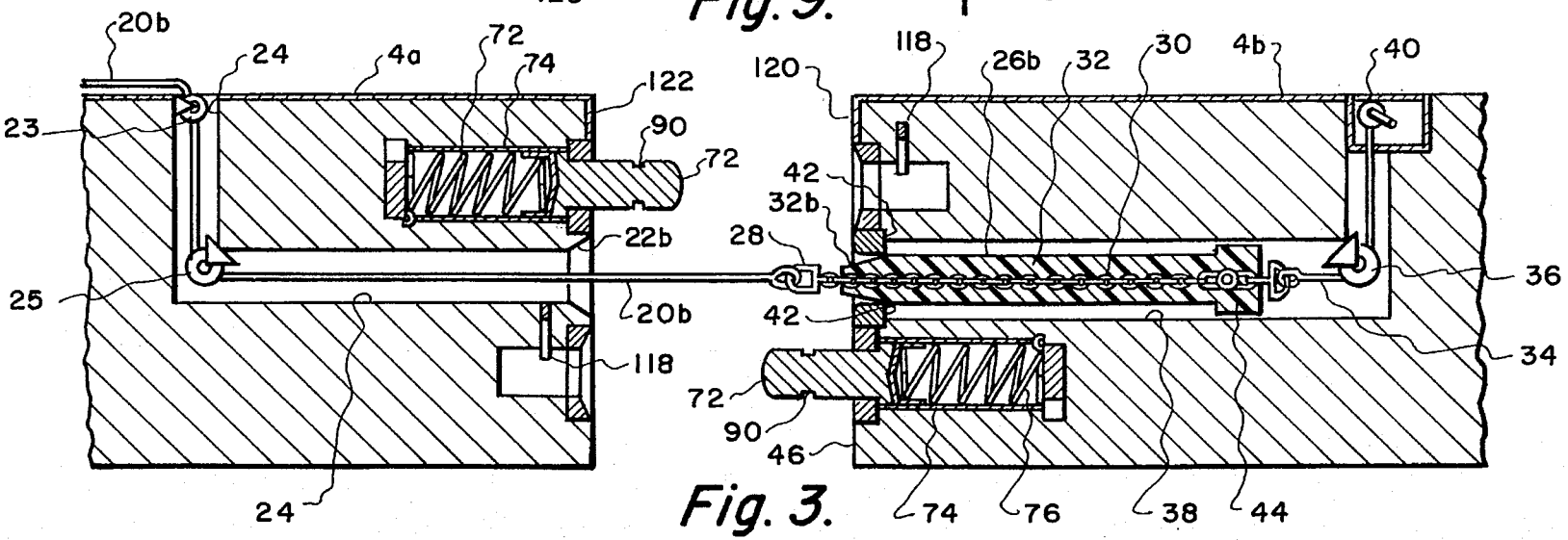
FIG. 3 is x-sectional view taken through the connector modules of two pontoons about to be joined.

As shown in FIG. 2, bridal line 14 includes first end 18 attached to winch 16 and second end 20. Second end 20 is split into segments 20*a* and 20*b* (ie a "Y" configuration), both segments 20*a* and 20*b* of bridal line 14 extending over the top surface of pontoon 4*a*. Segment 20*a* extends into and through guide bore 22 and segment 20*b* extends into and through guide bore 24. It should be noted, that guide bores 22 and 24 are the same in their component parts. Therefore, except as otherwise noted, only guide bore 24 shall be described in its component parts. FIG. 3 shows a cross section of guide bore 24 with rollers 23 and 25 guiding segment 20*b* through guide bore 24. Guide bore 22 is similarly configured for guiding segment 20*a*. Segment 20*b* is attached to one end of alignment pin 26*b* via ring 28. As shown in FIG. 3, alignment pin 26*b* is slidably located in donor bore 38. Alignment pin 26*b* includes chain 30 and elastomer 32, chain 30 being located in elastomer 32. The other end of alignment pin 26*b* includes stop plate 44 and is attached to reeling cable 34. Reeling cable is attached to winch 40. Pulley 36 guides reeling cable 34 within donor bore 38. Chain 30 may also, for example, be molded to elastomer 32 or otherwise communicate with elastomer 32 to form a non-yielding tension member having bending and/or non marring capability. The location of alignment pin 26*b* in donor bore 38 is controlled by winch 40. Alignment pin 26*b* may extend outwardly from face 46, the maximum extension limited by stop plate 44 contacting stop 42. Segment 20*a* of bridal line 14 is attached in a like fashion to an alignment pin (not shown) with stop plate, reeling cable and winch. FIG. 3 also shows bevel 22*b* of guide bore 24 for facilitating the entry of alignment pin 26*b* therein. In addition, alignment pin 26*b* (and 26*a*) includes tapered end 32*b* for facilitating the entry of alignment pin 26*b* into guide bore 24.

Figure 4:
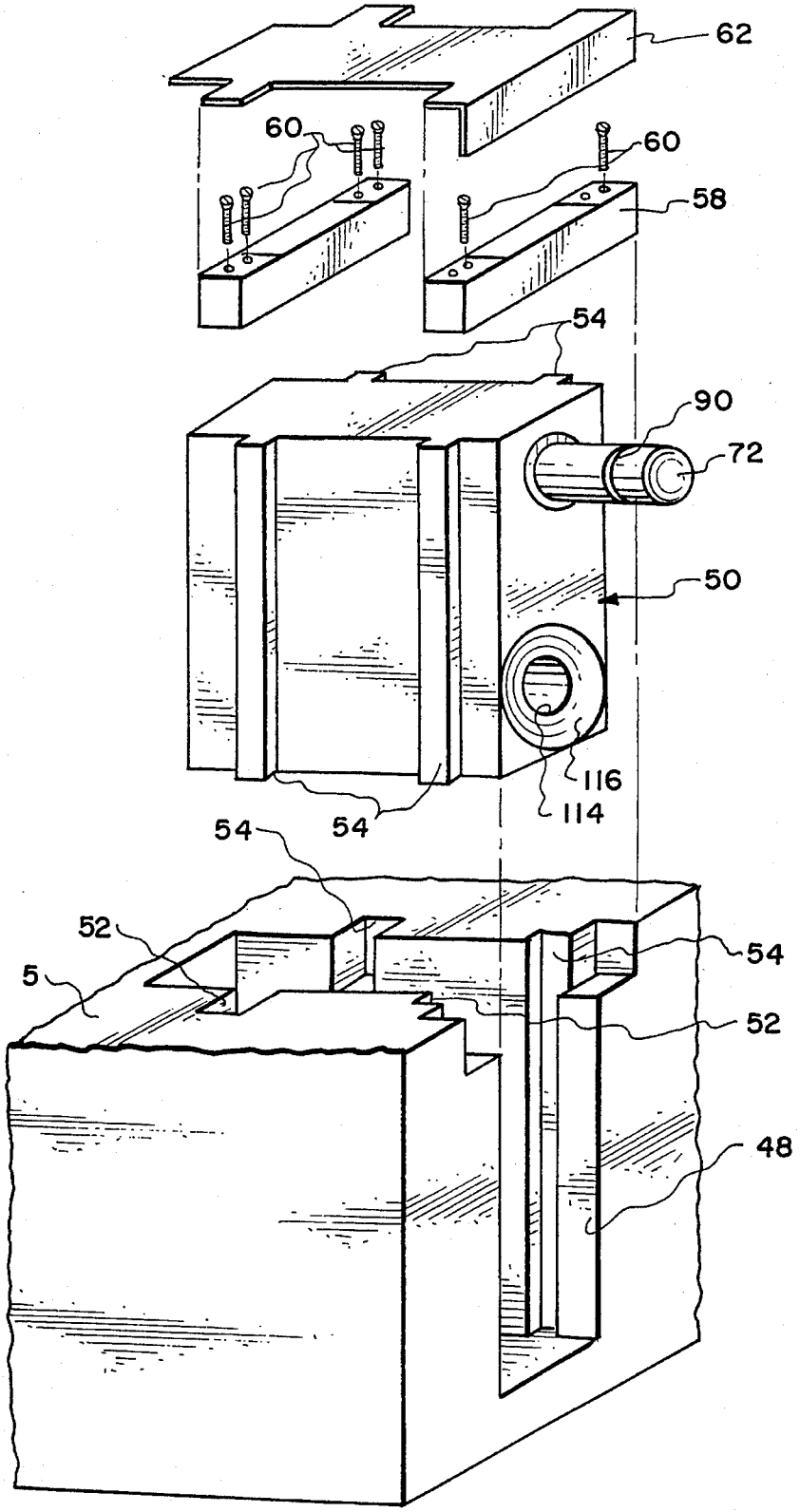
FIG. 4 is an illustration showing a connector module and pontoon pocket.

In the preferred embodiment, each forwardly and rearwardly facing end of each pontoon includes at least two watertight pockets 48 for receiving a connector module 50, see FIG. 4. Each barge pocket 48 includes mating slots 52 for receiving holding bars 54. The preferred embodiment includes 4 mating slots 52 and 4 holding bars 54 for each barge pocket 48. Connector module 50 is inserted into pocket 48 from deck 5 of pontoon 4 and secured in place by locking bars 58. Locking bars 58 are then attached to pontoon 4 by bolts 60. Top plate 62 covers locking bar 58 and provides a flush surface with deck 5. It should be noted that although the preferred embodiment shows pontoons being joined at the leading and trailing ends to form a continuous chain of pontoons, pontoons may also be joined at the sides to form a "block" of pontoons when, for example, more surface area is desired. In such a case, pontoon 4 would include pockets 48 on the appropriate side(s) or end(s) to accommodate the desired assembled shape. In addition, a pontoon may include other quantities of connector modules (ie 1, 3, or more) on a side or end as desired. In such a case the mating end or side must include the appropriate quantity of connector modules arranged and positioned for proper mating.

Figures 5, 5A, 5C:
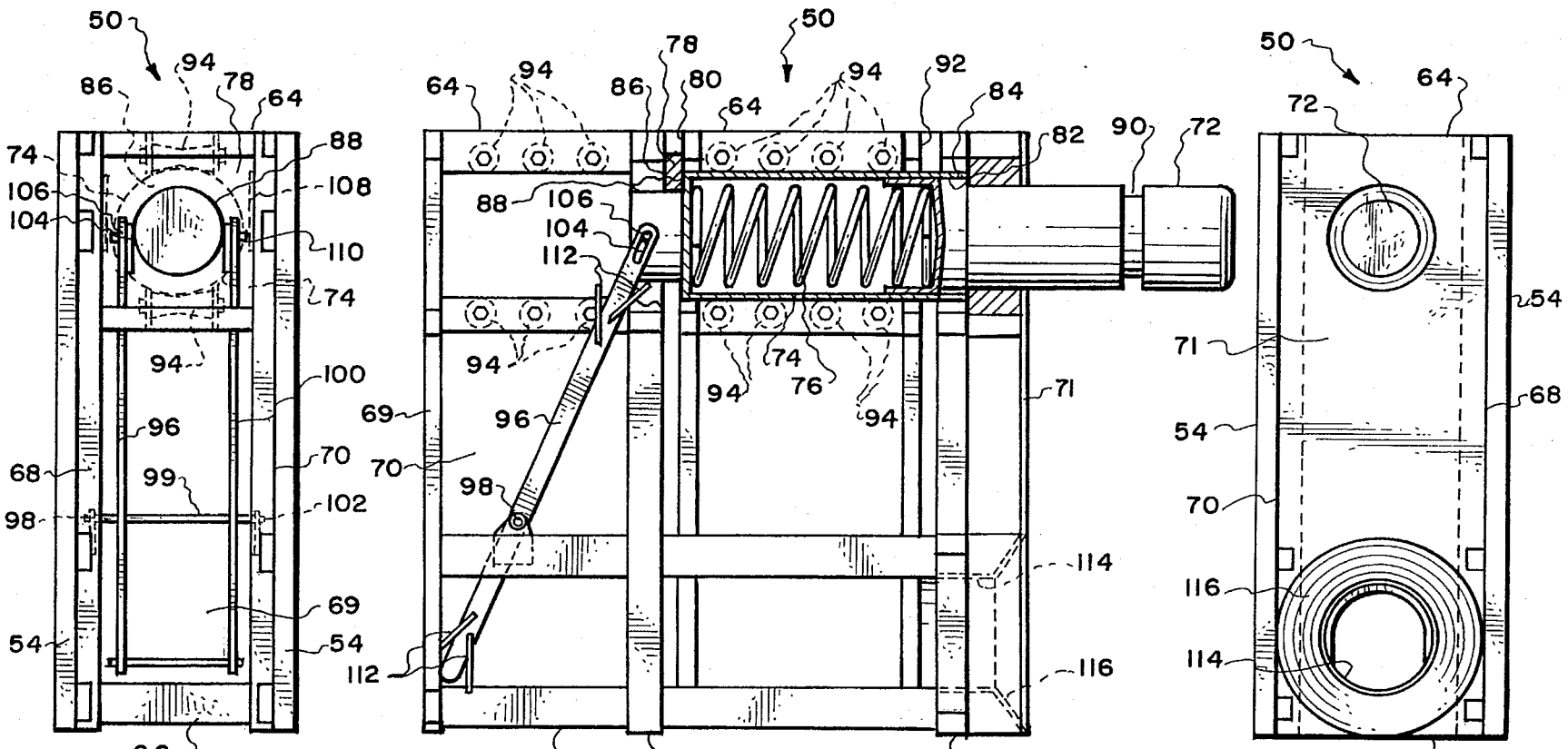
FIG. 5 is a side elevation view showing a connector module with the locking pin in the extended position.
FIG. 5*a* is an end view of the inwardly end of a connector module with the locking pin in the extended position.
FIG. 5*c* is an end view of the outwardly end of a connector module with the locking pin in the extended position.
Figure 5B:
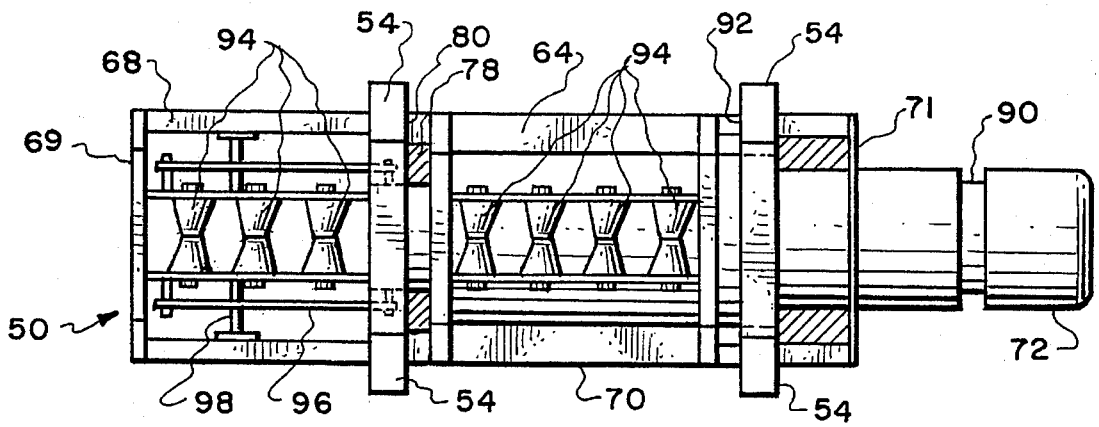
FIG. 5*b* is top view of a connector module with the locking pin in the extended position.
Figure 6B:
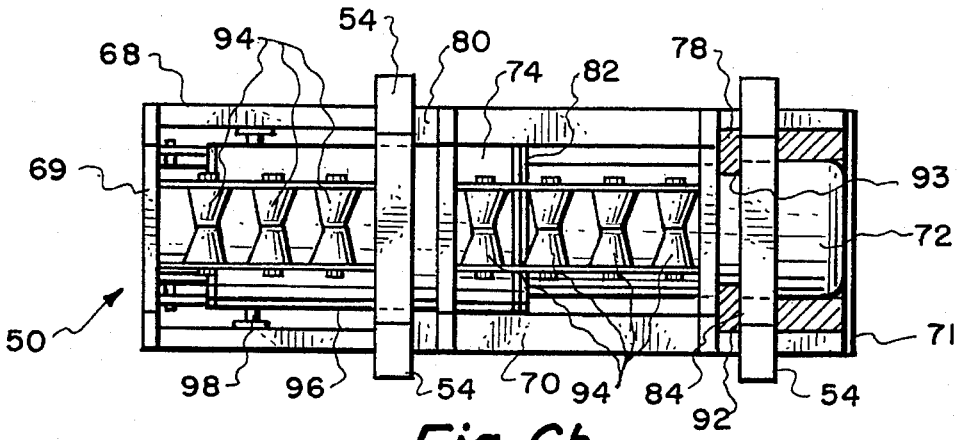
FIG. 6*b* is top view of a connector module with the locking pin in the retracted position.

As shown in FIG. 5, 5*a*, 5*b* and 5*c* connector module 50 includes top 64, bottom 66, side 68, side 70, back 69 and front 71, all formed, for example, by welding into a frame in the shape of a box. It should be noted that connector module 50 may be installed into pontoon 4 in an inverted fashion. In such a case, the "top" will become the "bottom" and vice versa. Unless otherwise indicated, "top" will refer to the surface nearest to locking pin 72 and the bottom will refer to the surface nearest to locking bore 104. Connector modules may also be arranged in a "horizontal" position with locking pin 72 on one side of receiver bore 114. In the preferred embodiment, each connector module 50 includes locking pin 72 slidably located in cannister 74 with spring 76 positioned therebetween, one end of spring 76 acting on cannister 74 and the other end of spring 76 acting on locking pin 72. FIG. 5 shows locking pin 72, cannister 74 and spring 76 in the fully extended (forwardly) position. In this position, shoulder 82 of locking pin 72 abuts face 84 thereby preventing additional forward motion of locking pin 72. Guillotine 78, inserted into guide 80, abuts rear surface 86 of cannister 74 and thereby locks cannister 74 in place by preventing cannister 74 from moving rearwardly. Surface 88 supports guillotine 78 in guide 80. Thus, locking pin 72 may be forcibly moved into cannister 74 when a sufficient compressive force is applied to locking pin 72, as in a collision with another pontoon. Locking pin 72 will return to the position in FIG. 5 when the compressive force is removed.

Locking pin 72, cannister 74 and spring 76 may also be located in the retracted (storage) position as shown in FIGS. 6, 6*a*, 6*b* and 6*c*. In the retracted position, locking pin 72 does not extend beyond front 71 of connector module 50 and guillotine 78 is inserted into groove 90 via guide 92 thus securing locking pin 72 in place. It should be noted, that guillotine 78 may not be fully inserted into guide 80 when cannister 74 is in the rearward position since the diameter of cannister 74 is greater than the width of opening 93 in guillotine 78. (see FIGS. 8 and 8*a*). Similarly, guillotine 78 may not be fully inserted into guide 92 unless groove 90 is aligned with guide 92. Rollers 94, located above and below cannister 74, support and guide cannister 74 when cannister 74 is moved forwardly and rearwardly.

First arm 96 and second arm 100 are attached to cross member 99. Cross member 99 is attached to pivot 98 on one side and to pivot 102 on the other side. One end of first arm 96 is attached to pin 106 via slot 104. Similarly, one end of second arm 100 is attached to pin 108 via slot 110. Ears 112 extend outwardly from each end of first arm 96 and second arm 100. The ears are positioned so that a pry bar, not shown, may be used to exert force on ears 112 thereby causing cannister 74 to be moved forwardly (see FIG. 5) or rearwardly (see FIG. 6).

Figure 8:
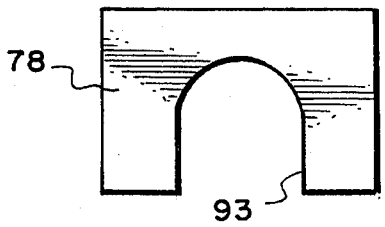
FIG. 8 is a illustration showing a typical guillotine.
Figure 8A:
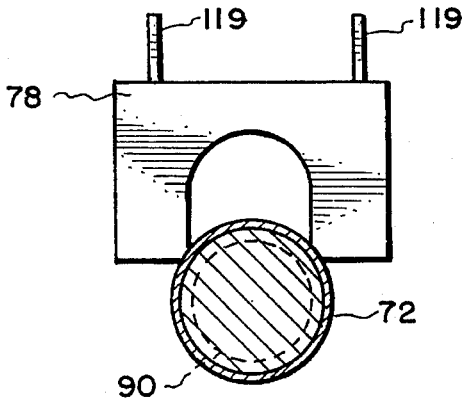
FIG. 8*a* is an illustration showing a guillotine being inserted to lock a locking pin into the extended position.
Figure 6C:
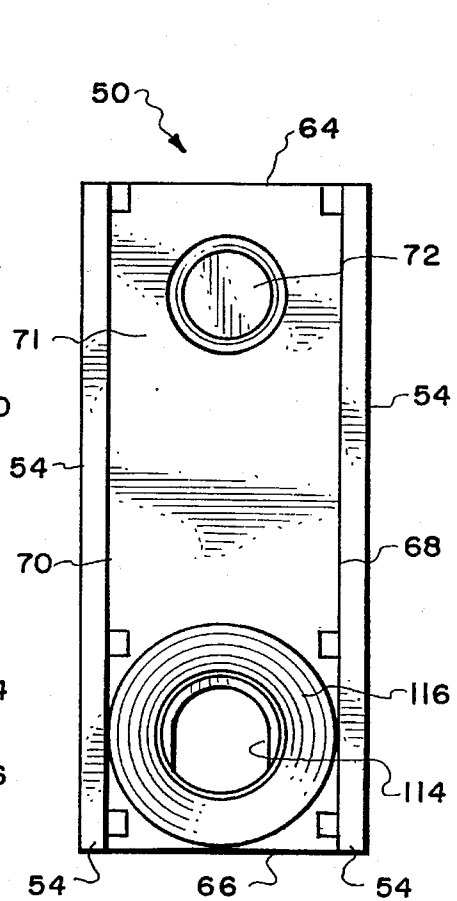
FIG. 6*c* is an end view of the outwardly end of a connector module with the locking pin in the retracted position.
Figure 6:
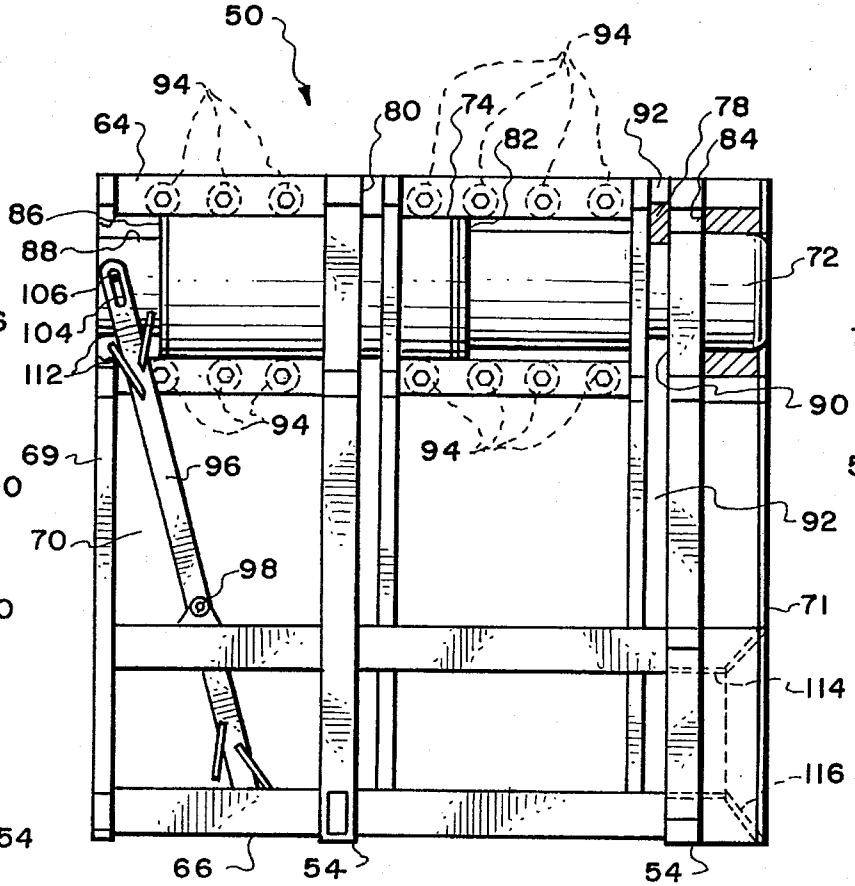
FIG. 6 is a side elevation view showing a connector module with the locking pin in the retracted position.
Figure 6A:
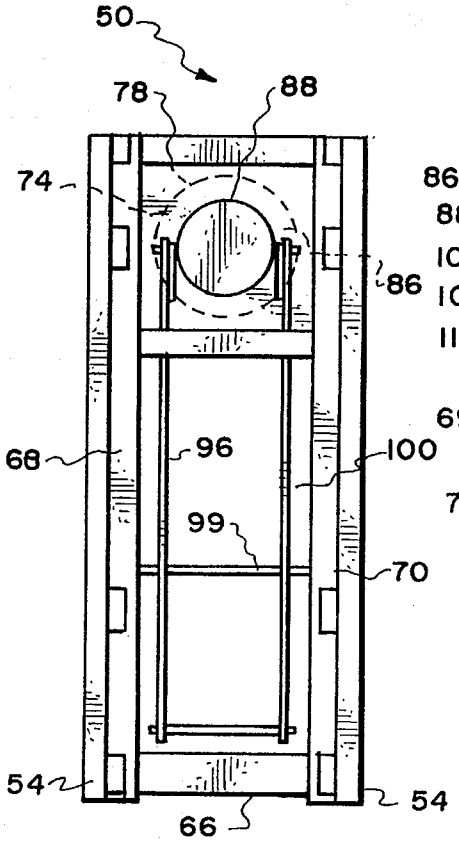
FIG. 6*a* is an end view of the inwardly end of a connector module with the locking pin in the retracted position.

Connector module 50 includes receiver bore 114 located below locking pin 72 as shown, for example, in FIG. 5 and 5*c* and in FIGS. 6 and 6*c*. The outwardly end of receiver bore 114 includes bevel 116 to facilitate the entry of a mating locking pin from an adjacent pontoon. Guillotine 118 is slidably located in guide 92. When two pontoons are joined, the locking pin of an adjacent pontoon will be positioned in receiver bore 114 and may be locked in place by slidably positioning guillotine 118 in guide 92 to engage groove 90 of a mating locking pin thus preventing the locking pin from being prematurely withdrawn. FIG. 8*a* shows rods 119 screwably attached to guillotine 78 to assist an operator in raising or lowering guillotine 78. In a like manner, rods 119 may be attached, as required, to guillotine 118.

Figure 7:
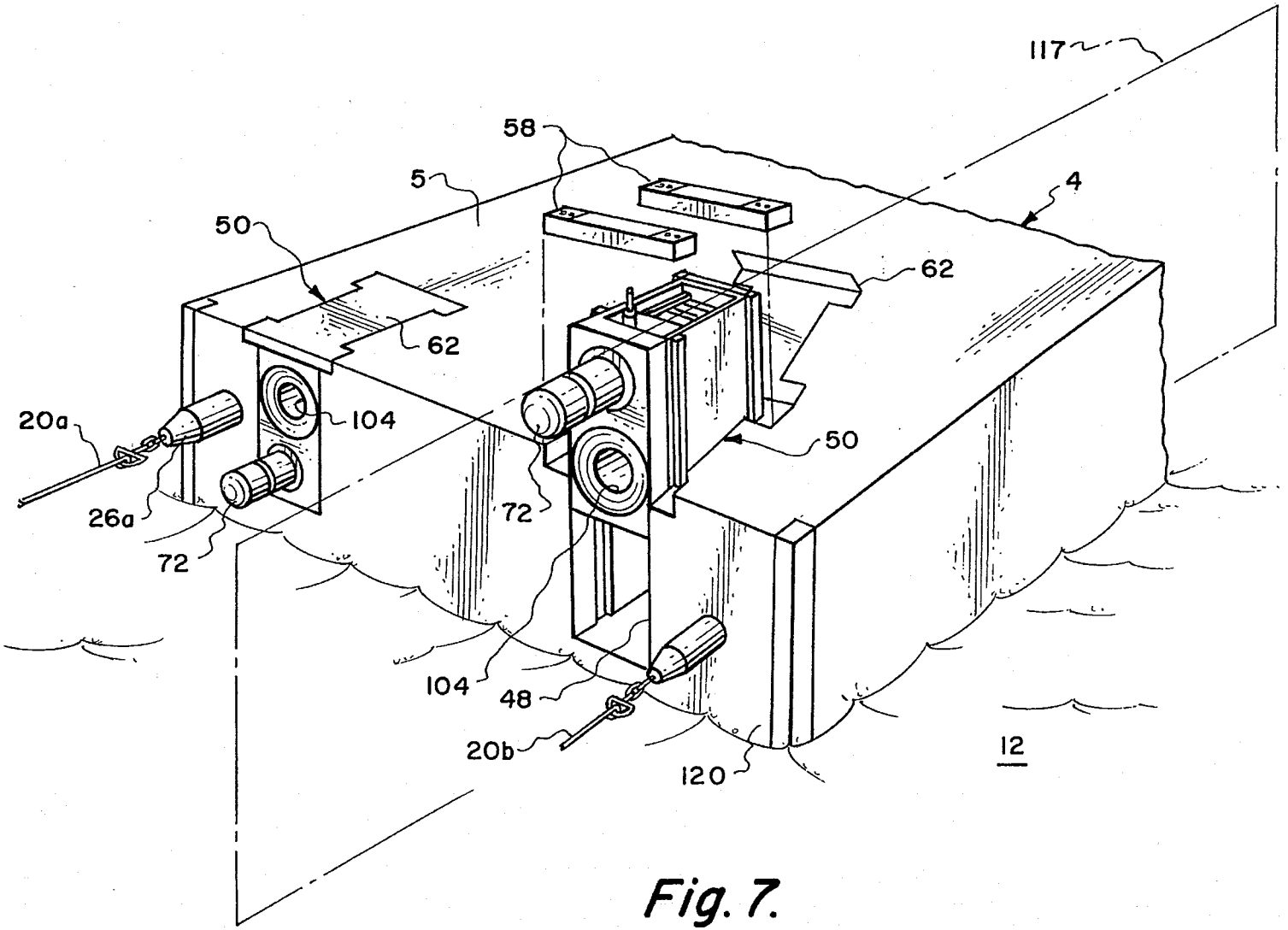
FIG. 7 is an illustration showing a pontoon with one connector module installed and one connector module being installed in the leading end of a pontoon.

FIG. 7 shows a typical pontoon 4 with a leading end 120 and a trailing end 122. It is envisioned that a plurality of pontoons 4 will be assembled in an end to end fashion to form a array of pontoons of desired length. Accordingly, it should be noted that end 120 and end 122 are mirror images of one another and may be in a leading or trailing configuration, as required. Note also, that connector modules 50 may be installed in a "regular" or an "inverted" fashion. FIG. 7 shows one connector module 50 installed in the inverted fashion (with locking pin 72 adjacent the sea surface 12) and one connector module 50 being installed in the "regular"

fashion (with locking pin 72 adjacent deck 5 of pontoon 4). Connector modules 50 are positioned an equal distance on either side of centerline 117. Similarly, alignment pins 26*a* and 26*b* are positioned an equal distance on either side of centerline 117 and equidistant from deck 5. In this way, either end of a pontoon 4 may mate with any end of another pontoon. It should be noted that, when pontoon 4 is out of service, alignment pin 26*a* (and 26*b*) is retained within its respective donor bore 38 by operating winch 40 to tension reeling cable 34.

Figure 9:
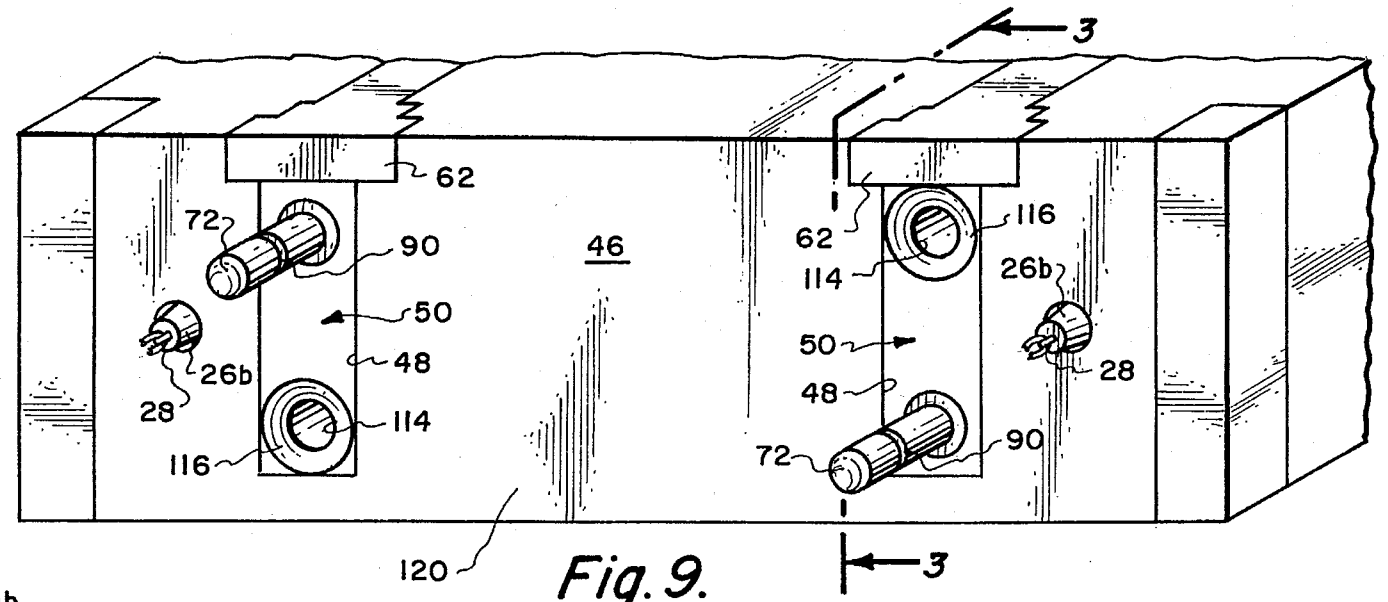
FIG. 9 is an illustration showing the leading end of a pontoon having two connector modules.

FIG. 9 shows the leading end 120 of a typical pontoon having two connector modules 50 installed. Note, that the connector modules are installed in the opposite manner as compared to FIG. 7.

When it is desired to connect two pontoons (for example 4*a* and 4*b* shown in FIG. 2), the trailing end 122 of a first pontoon 4*a* is positioned adjacent the leading end 120 of a second pontoon 4*b*. Barge 10 is positioned ahead of first pontoon 4*a*. Winches 40 are then operated to relax reeling cables 34 and thereby allow alignment pins 26*a* and 26*b* to be extended beyond leading end 120 until stop plates 44 abut stops 42. Segment 20*a* is then connected to alignment pin 26*a* (in pontoon 4*b*) via guide bore 22 (in pontoon 4*a*) and segment 20*b* is connected to its respective alignment pin 26*b* (in pontoon 4*b*) in a like fashion via guide bore 24 (in pontoon 4*a*). Locking pins 72 are extended by removing guillotines 78 and, using a pry bar or similar tool, exerting force on ears 112 to urge locking pins 72 outwardly until shoulders 82 abut faces 84. Guillotines 78 are then inserted into guides 80 to lock locking pins 72 in place. To facilitate the operation, pretensioning may be provided to the trailing pontoon (pontoon 4*b* in FIG. 2) via pretension lines 7. Winch 16 is then operated to reel in bridal line 14 thereby causing pontoons 4*a* and 4*b* to be drawn together until alignment pins 26 first engage enlarged openings 22*a* and 22*b* and then mate with guide bores 24. Further operation of winch 16 causes locking pins 72 to first engage bevels 116 and then mate with receiver bores 114. It should be noted that locking pins 72 may compress and absorb impacts due to misalignments between locking pins 72 and receiver bores 114 caused by an undulating sea. Winch 16 is operated until trailing end 122 of pontoon 4*a* abuts leading end 120 of pontoon 4*b*. Guillotines 118 are then positioned to lock locking pins 72 into receiver bores 114.

Obviously, many modifications and variations of the present invention are possible in light of the above teachings. It is therefore to be understood that within the scope of the appended claims, the invention may be practiced otherwise than as specifically described.

What is claimed is:

1. A pontoon locking system for drawing together, aligning and locking together two or more pontoons in an end to end fashion, comprising:

a) a first pontoon having a deck, a leading end and a trailing end, the trailing end including a locking pin and a receiver bore, said locking pin extending rearwardly from said trailing end;

b) a second pontoon, having a deck, a leading end and a trailing end, the leading end including a locking pin and a receiver bore, the locking pin extending forwardly from said leading end, said locking pins in said first and second pontoons communicating with said receiver bores when said first and said second pontoons are aligned and locked together;

c) an alignment pin extending forwardly from said leading end of said second pontoon;

d) a guide bore extending from said trailing end of said first pontoon to the deck of said first pontoon, said guide bore and said alignment pin communicating when said first and said second pontoons are aligned and drawn together;

e) a bridal line attached on one end to said alignment pin and extending through said guide bore;

f) a barge attached to the leading end of said first pontoon, the barge including means attached to the other end of said bridal line for reeling in said bridal line and drawing together said pontoons;

g) a guillotine communicating with said locking pin and said receiver bore for locking said pontoons together when said pontoons are aligned and drawn together.

2. The apparatus defined in claim 1, further including a cannister and a spring, said locking pin slidably located in the cannister and the spring located therebetween, one end of said spring acting on said cannister and the other end of said spring acting on said locking pin to normally bias said locking pin in the extended position.

3. The apparatus defined in claim 2, further including a plurality of rollers and first and second arms, the rollers located on opposite sides of said cannister for guiding said cannister rearwardly and forwardly and the first and second arms communicating with said cannister for exerting force on said cannister to move said cannister forwardly or rearwardly.

4. The apparatus defined in claim 3, wherein said locking pin, cannister, spring, first and second arms, and receiver bore are located in a removable and invertible connector module, the connector module located in a pocket in said pontoon for receiving said connector module.

5. The apparatus defined in claim 4, further including a winch, a reeling cable and a donor bore, the donor bore extending from said leading end of said second pontoon to said deck of said second pontoon, said alignment pin movably located in said donor bore, one end of said reeling cable attached to said alignment pin and the other end of said reeling cable attached to the winch via said donor bore, said winch operable to position said alignment pin in said donor bore.

6. The apparatus defined in claim 5, further including a second barge attached to the trailing end of said second pontoon for providing a drag on said second pontoon.

7. A pontoon locking system for drawing together, aligning and locking together two or more pontoons in an end to end fashion, comprising:

a) a first pontoon having a deck, a leading end and a trailing end, the trailing end including two connector modules, each connector module having a locking pin and a receiver bore, said locking pin extending rearwardly from said trailing end;

b) a second pontoon, having a deck a leading end and a trailing end, the leading end including two connector modules, each connector module having a locking pin and a receiver bore, the locking pin extending forwardly from said leading end, said locking pins in said first and second pontoons communicating with said receiver bores when said first and said second pontoons are aligned and locked together;

c) two alignment pins extending forwardly from said leading end of said second pontoon;

d) two guide bores extending from said trailing end of said first pontoon to the deck of said first pontoon, said guide bores and said alignment pins communicating when said first and said second pontoons are aligned and drawn together;

e) a bridal line having first and second ends, the second end having first and second segments, the first segment extending through one said guide bore and attached to one said alignment pin and the second segment extending through the other said guide bore and attached to the other said alignment pin;

f) a barge attached to the leading end of said first pontoon, the barge including means attached to the first end of said bridal line for reeling in said bridal line and drawing together said pontoons;

g) means communicating with said locking pins and said receiver bores for locking said pontoons together when said pontoons are aligned and drawn together.

8. The apparatus defined in claim 7, wherein each said locking pin is slidably located in a cannister and a spring is located therebetween, one end of said spring acting on said cannister and the other end of said spring acting on said locking pin to normally bias said locking pins in the extended position, said locking pins compressible when an axial force is applied to said locking pins.

9. The apparatus defined in claim 8, wherein each said connector module includes a plurality of rollers and arms, the rollers located on opposite sides of each said cannister for guiding said cannister rearwardly and forwardly, the arms communicating with each said cannister for exerting force on each said cannister to move each said cannister forwardly or rearwardly.

10. The apparatus defined in claim 9, further including a plurality of pockets located in said leading end and in said trailing end of each pontoon, each pocket for receiving one said connector module.

11. The apparatus defined in claim 10, further including a winch, a reeling cable and a donor bore, the donor bore extending from said leading end of said second pontoon to said deck of said second pontoon, said alignment pin movably located in said donor bore, one end of said reeling cable attached to said alignment pin and the other end of said reeling cable attached to the winch via said donor bore, said winch operable to position said alignment pin in said donor bore.

12. The apparatus defined in claim 11, further including a second barge attached to the trailing end of said second pontoon for providing a drag on said second pontoon.

13. The apparatus defined in claim 12, wherein said connector modules in said trailing end of said first pontoon and said connector modules in said leading end of said second pontoon are positioned an equal distance on either side of the centerline of said pontoons.

14. The apparatus defined in claim 13, further including three or more connector modules in said trailing end of said first pontoon and a like number of connector modules in said leading end of said second pontoon.

15. The apparatus defined in claim 14, wherein said alignment pin includes a chain and an elastomer, the chain located in the elastomer.

* * * * *